US006082550A

United States Patent [19]

Metzner et al.

[11] Patent Number: 6,082,550

[45] Date of Patent: Jul. 4, 2000

[54] COOLING AND SIEVE DRUM FOR TOBACCO MATERIAL

[75] Inventors: Wolfgang Metzner, Bindlach; Uwe-Peter Körner, Neuenmarkt, both of Germany

[73] Assignee: Brown & Williamson Tobacco Corporation, Louisville, Ky.

[21] Appl. No.: 09/183,312

[22] Filed: Oct. 30, 1998

[30] Foreign Application Priority Data

Dec. 4, 1997 [DE] Germany ..... 197 53 865

[51] Int. Cl.[7] ..... B07B 1/24

[52] U.S. Cl. ..... 209/294; 209/298; 131/305; 131/312

[58] Field of Search ..... 209/284, 288, 209/294, 298, 299, 247; 131/302, 304, 305, 306, 312

[56] References Cited

U.S. PATENT DOCUMENTS

| | | | |
|---|---|---|---|
| 572,966 | 12/1896 | Cross | 209/298 |
| 583,216 | 5/1897 | Phillips | 209/298 X |
| 2,440,008 | 4/1948 | Gardner | 209/288 |
| 3,087,499 | 4/1963 | Carmichael, Jr. et al. | 209/288 X |
| 5,628,912 | 5/1997 | Nesseth | 209/299 X |

FOREIGN PATENT DOCUMENTS

| | | |
|---|---|---|
| 0338099 | 10/1989 | European Pat. Off. . |
| 1632157 | 3/1973 | Germany . |
| 229145 | 10/1943 | Switzerland . |
| 502225 | 3/1939 | United Kingdom . |

OTHER PUBLICATIONS 3 articles by "Kim, Kimf—Kuhl und Siebtrammeln", by Korber AG.

*Primary Examiner*—David H. Bollinger
*Attorney, Agent, or Firm*—Middelton & Reutlinger; John F. Salazar; Charles G. Lamb

[57] ABSTRACT

The invention relates to a cooling and screening drum for tobacco materials comprising a material inlet, a rotary drum including lifting webs running longitudinally along the inner wall, a cross-flow cooling system and a material outlet, the lifting webs being configured inclined obliquely to the inner wall contrary to the direction of rotation of the drum.

7 Claims, 1 Drawing Sheet

COOLING AND SIEVE DRUM FOR TOBACCO MATERIAL

BACKGROUND OF THE INVENTION

1. Field of the Invention

The invention relates to a cooling and screening drum for tobacco materials comprising a material inlet, a rotary drum including lifting webs running longitudinally along the inner wall, a recirculating air system and a material outlet, wherein said lifting webs are configured inclined obliquely to said inner wall contrary to the direction of rotation of said drum.

2. Description of the Related Art

Tobacco materials, especially as employed in cigarette production, are dried in the course of their processing as cut tobacco. In prior art the dried cut tobacco is directed into a so-called cooling and sieve (screening) drum for it to be cooled and dedusted prior to further treatment, such as flavoring, for example, taking place.

Such cooling and screening drums are relatively large drum-shaped chambers having a material inlet and a material outlet rotating about their longitudinal axis thereby axially conveying the tobacco. The wall of the drum is configured like a strainer/sifter and the tobacco dust to be removed is drawn off downwards with the aid of an air flow acting transversely to the conveying direction. After having passed through the drum the tobacco is prepared for further treatment and may be flavored.

So that the tobacco may be adequately intermingled or tumbled in the drum, lifting or tumbling devices are provided on the inner wall of the drum which are variously configured in prior art. Thus, the KIM and KIMF type cooling and screening drums of the Körber Company comprise sheet metal webs radially extending from the drum inner wall towards the longitudinal axis featuring a relatively large radial height and running along the full length of the drum. In this case, for example, six such longitudinal plates are provided symmetrically distributed about the circumference in the drum.

The Swiss patent No. 229 145 shows a drum dryer having a perforated casing and transverse ventilation in which paddles having curved ends are provided running up to almost the drum axis as tumbling means.

Known from GB-A-502,225 is a rotary dryer for tobacco comprising blades protruding almost vertically at the inner circumference for distributing the tobacco. All of these known devices have in particular the disadvantage that the cut tobacco is subjected to very rough treatment on being introduced into the drum and during its conveyance. It receives heavy impact on impinging the radially arranged, relatively large tumbling means since on rotary movement of the drum it impacts the walls thereof mostly vertically. In addition to this, after slipping from the lifting edges it drops a long way to the bottom of the drum due to the relatively large, radial extent of the lifting edges.

The disadvantage resulting from such a rough treatment of the tobacco is that new tobacco dust materializes in the drum. In addition to this the filling capacity of the tobacco due to such treatment is reduced by up to 5%, i.e. an undesirable degradation of the tobacco occurs.

SUMMARY OF THE INVENTION

It is the object of the present invention to provide a cooling and screening drum for tobacco material which obviates the aforementioned disadvantages of prior art.

More particularly, the intention of a cooling and screening drum in accordance with the invention is to practically eliminate new dust materializing in the drum as well as degradation of the tobacco.

This object is achieved in accordance with the invention in that the lifting webs running along the inner wall of the rotary drum as the tumbling means of the cooling and screening drum are configured inclined obliquely to the inner wall contrary to the direction of rotation of the drum.

Inclining the lifting webs in accordance with the invention prevents the tobacco from vertically impacting the walls of these webs in the rotary drum. The cut tobacco now receives only a relatively mild impact without being further disintegrated into smaller dust particles. The degradation of the tobacco may also be practically eliminated by such a "gentle" treatment of the tobacco so that the filling capacity is retained.

Preferably the lifting webs adjoin the inner wall of the drum at the base point at an angle of 10 to 60°, preferably 25 to 45°.

In one embodiment of the present invention the lifting webs of the cooling and screening drum are shaped curved in cross-section, more particularly concave in the direction of the interior of the drum. In such a configuration the lifting web in the region of the base point may run almost parallel to the inner surface area of the drum, as a result of which heavy impact of the tobacco particles is eliminated practically completely. Due to the curvature of said surface area the tobacco is subjected to a gradual change in direction, sufficient tumbling and distribution of the tobacco occurring on it slipping past the free edge at the end point of curvature.

For a gentle treatment of the cut tobacco it is important to avoid it dropping over large distances in the drum. This is the reason why in one preferred embodiment of the cooling and screening drum in accordance with the invention the maximum spacing of the lifting webs at their free end from the inner wall of the drum is approximately 30 to 120 mm and preferably approximately 50 mm. In such small radially lifting web distances the tobacco falls relatively early from the lifting web edge on rotation of the drum so that a long fall and thus a heavy impact upon impinging the bottom of the drum may be avoided. This too, contributes to preventing dust forming as well as degradation of the tobacco.

Another possibility of achieving a more gentle treatment of the cut tobacco consists in accordance with the invention of maintaining the number of lifting webs as small as possible. This is the reason why in accordance with the invention not more than four, preferably, however, only two, lifting webs are provided in the cooling and screening drum symmetrically disposed about the inner circumference of the drum.

Yet another aspect of the present invention relates likewise to the careful treatment of the cut tobacco. The tobacco material is subjected to relatively heavy impact in conventional cooling and screening drums as soon as it is fed through the material inlet since it is usually thrown off into the drum in arriving from a vibrating chute. This vibrating chute serving as the feeder is located at its end roughly level with the longitudinal axis of the drum or even slightly higher. In dropping from the vibrating chute to the bottom of the drum the tobacco is subjected to a relatively heavy impact when impinging the bottom on the inside of the drum due to the relatively high drop involved.

In accordance with the invention the aforementioned problem at the material inlet is solved by a material guidance for the tobacco material being provided, running from a feeder, more particularly a vibrating feed chute, to the bottom of the drum on the inside.

Now, the material is not just "tossed" into the drum, it instead being guided to the bottom of the drum where it drops over a relatively small distance. This prevents heavy impact, retaining the filling capacity of the tobacco and avoiding the risk of new tobacco dust materializing.

In accordance with another preferred embodiment of the configuration as cited above, the material guidance comprises a material chute via which the tobacco is able to glide down almost to the bottom of the drum on the inside.

BRIEF DESCRIPTION OF THE DRAWINGS

The invention will now be discussed in more detail with reference to the accompanying drawings in which.

DESCRIPTION OF THE PREFERRED EMBODIMENTS

Figure 1:
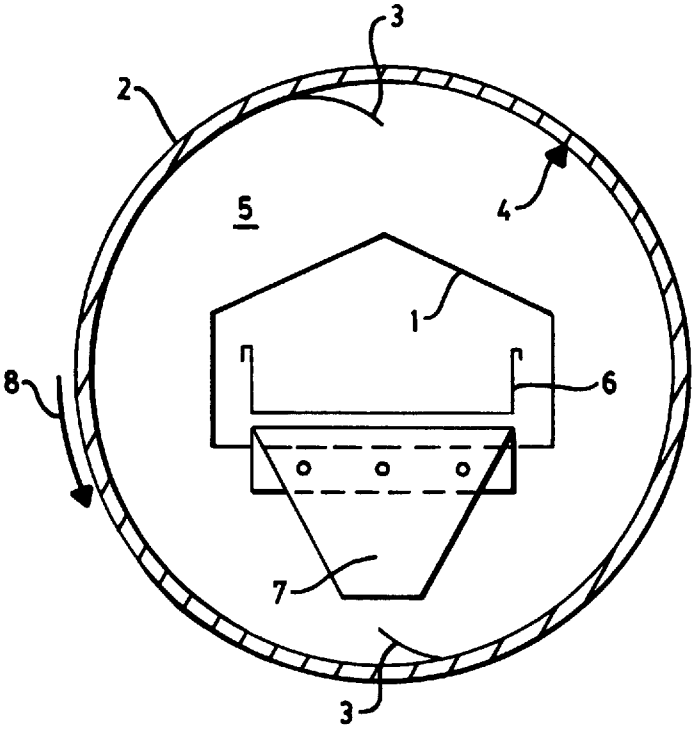
FIG. 1 is a cross-section through a cooling and screening drum in accordance with the invention as viewed in the direction of the material outlet.

Referring now to FIG. 1 there is illustrated schematically a cross-section of one embodiment of the cooling and screening drum in accordance with the invention. The cooling and screening drum consists of a rotary drum 2, on the inner wall of which lifting webs 3 are fitted. To prevent heavy impact of the cut tobacco only two lifting webs 3 are arranged at locations opposite each other on the inner wall 4 of the drum. The lifting webs 3 run longitudinally along the inner wall 4 of the drum as is evident from FIG. 2.

Also evident from FIG. 1 is the material inlet 1 at the face wall of the drum 2 incorporating a vibrating chute 6 and a tobacco chute 7. These components will be discussed in more detail with reference to FIG. 2.

As regards the functioning of the cooling and screening drum in accordance with the invention, the tobacco is introduced into the interior 5 of the drum via the material inlet 1 by means of the tobacco chute 7. The tobacco attains the bottom of the drum 2 where it comes to rest on the inner wall 4 of the drum. Rotation of the drum 2 in the direction of the arrow 8 circulates the cut tobacco. The lifting webs 3 serve in this arrangement to tumble and distribute the tobacco sufficiently.

Not shown is a recirculating air system which sucks the tobacco downwards from the sifter-like configuration of the drum 2.

As regards gentle treatment of the cut tobacco the inclination and shape of the lifting webs 3 are of great importance. On rotation of the drum 2 in the direction of the arrow 8 the tobacco is gently lifted over the webs 3 curved concave towards the interior 5 before then dropping off relatively early to the inner bottom of the drum. Unlike the situations in conventional drums where the lifting webs are oriented radially, now the tobacco material is no longer heavily impacted and formation of new dust as well as degradation of the tobacco avoided.

The tobacco is slowly lifted at base points of the lifting webs 3, its direction of movement thereby gradually changing. This is the reason why less tobacco remains sticking to the lifting webs 3 than in conventional drums where the tobacco impinges the lifting web wall vertically.

Further factors contributing towards a more gentle treatment of the cut tobacco are the low radial height of the free edge of the lifting webs 3 as well as the arrangement of only two lifting webs at the inner wall 4 of the drum.

Demonstratively the cut tobacco discharged from the material outlet (not shown) features much less degradation.

Figure 2:
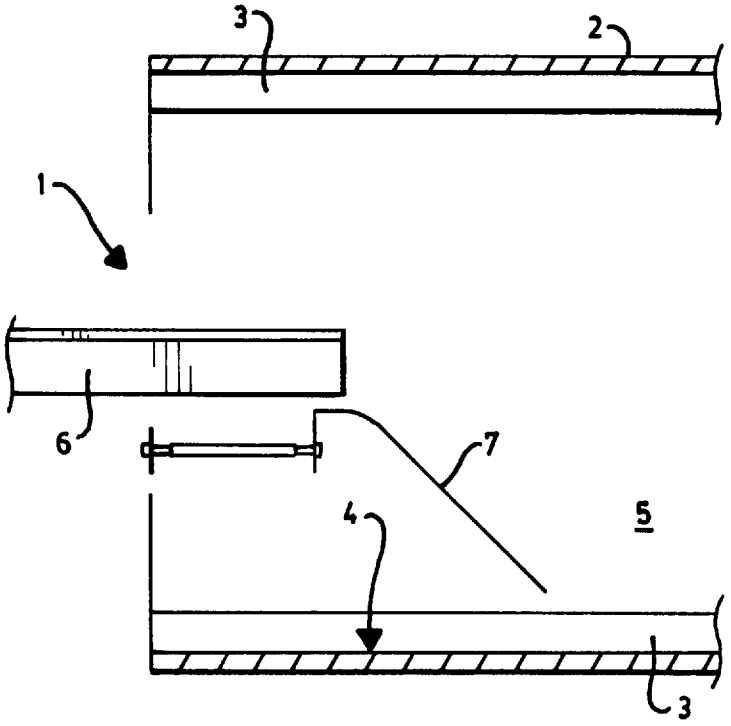
FIG. 2 is a longitudinal section through a cooling and screening drum in accordance with the invention in the region of the material inlet.

Referring now to FIG. 2 there is illustrated a partial longitudinal section through the second aspect in accordance with the invention for a more gentle treatment of the tobacco. Via the material inlet 1 the tobacco, arriving from the dryer, is delivered by a vibrating chute 6 into the rotary drum 2. The vibrating chute 6 is located roughly level with the longitudinal axis of the drum 2. Secured to the inner wall 4 of the drum 2 are the lifting webs 3 which, as evident from this Figure, extend over the full length of the drum.

Now, instead of simply allowing the tobacco to drop from the vibrating chute 6 to the inner bottom of the drum, as is usual in prior art, a tobacco chute 7 is made available in accordance with the invention which is fitted below the end of the vibrating chute 6. The tobacco chute 7 runs inclined from the end of the vibrating chute to the inner bottom of the drum 2. This causes the tobacco, as guided by the tobacco chute 7, to slowly slide into the interior 5 of the drum without needing to drop from any great height. Heavy impact of the tobacco material is avoided which in turn diminishes the formation of new tobacco dust and maintaining the filling capacity of the cut tobacco at a high level.

The configuration of the lifting webs in accordance with the invention and providing a material guide, such as for example the tobacco chute 7, each, but also in combination, contributes towards a more gentle treatment of the cut tobacco.

For a high volume throughput of tobacco through the cooling and screening drum thus configured it is possible to provide a cooling belt, e.g. as set forth in DE-OS 43 20 170, at the output of the drum for further cooling down the tobacco.

What is claimed is:

1. A cooling and screening drum for tobacco materials comprising a material inlet into a rotary drum including lifting webs running longitudinally along an inner wall of said drum, a recirculating air system and a material outlet, wherein said lifting webs curve concave towards an interior of said drum contrary to the direction of rotation of said drum, said material inlet including a centrally disposed tobacco feeder in flow communication with a feed end of a tobacco chute, said tobacco chute having a discharge end extending downwardly from said feed end and spaced a selected distance from said inner wall of said drum.

2. The cooling and screening drum as set forth in claim 1, wherein said lifting webs adjoin said inner wall of said drum at the base point at an angle of 10 to 60°.

3. The cooling and screening drum as set forth in claim 2, wherein said lifting webs adjoin said inner wall of said drum at the base point at an angle of 25 to 45°.

4. The cooling and screening drum as set forth in claim 1, wherein the maximum spacing of said lifting webs at their free edges from said inner wall of said drum is approximately 30 to 120 mm.

5. The cooling and screening drum as set forth in claim 4, wherein the maximum spacing of said lifting webs at their free edges from said inner wall of said drum is approximately 50 mm.

6. The cooling and screening drum as set forth in claim 1, wherein not more than four lifting webs are provided symmetrically disposed about the inner circumference of said drum.

7. The cooling and screening drum as set forth in claim 1, wherein said feeder is a vibrating feed chute.

* * * * *